US008210386B2

(12) United States Patent
Barrett et al.

(10) Patent No.: US 8,210,386 B2
(45) Date of Patent: Jul. 3, 2012

(54) APPARATUS AND SYSTEM FOR WASTE MANAGEMENT

(76) Inventors: Donald R. Barrett, Lincoln, NE (US); Richard J. Baranowski, Scottsdale, AZ (US)

( * ) Notice: Subject to any disclaimer, the term of this patent is extended or adjusted under 35 U.S.C. 154(b) by 976 days.

(21) Appl. No.: 12/191,241

(22) Filed: Aug. 13, 2008

(65) Prior Publication Data

US 2008/0302801 A1 Dec. 11, 2008

Related U.S. Application Data

(63) Continuation-in-part of application No. 11/067,215, filed on Feb. 25, 2005, now abandoned, and a continuation-in-part of application No. 11/318,357, filed on Dec. 22, 2005, and a continuation-in-part of application No. 11/358,013, filed on Feb. 21, 2006, and a continuation-in-part of application No. 11/412,234, filed on Apr. 25, 2006.

(51) Int. Cl.
*B65D 25/14* (2006.01)
*B65D 21/02* (2006.01)
*B65D 1/24* (2006.01)

(52) U.S. Cl. ..... 220/495.07; 220/23.87; 220/528; 220/908

(58) Field of Classification Search ..... 220/495.07, 220/23.87, 528, 702, 908, 908.1; 206/554; 221/46, 197, 287; 222/165, 325, 327
See application file for complete search history.

(56) References Cited

U.S. PATENT DOCUMENTS

| | | | | | |
|---|---|---|---|---|---|
| 4,721,226 | A | * | 1/1988 | Yurko | 220/495.07 |
| 4,850,507 | A | * | 7/1989 | Lemongelli et al. | 220/495.07 |
| 5,372,272 | A | * | 12/1994 | Jennings | 220/495.07 |
| 5,405,041 | A | * | 4/1995 | Van Brackle | 220/495.07 |
| 5,458,259 | A | | 10/1995 | Falk | |
| 5,503,292 | A | | 4/1996 | Cuccharia | |
| 5,509,570 | A | * | 4/1996 | DeMatteis | 221/33 |
| 5,628,424 | A | | 5/1997 | Gola | |
| 5,632,401 | A | * | 5/1997 | Hurd | 220/495.07 |
| 5,655,682 | A | * | 8/1997 | Hoffrichter | 221/45 |
| 5,671,847 | A | | 9/1997 | Pedersen et al. | |
| 5,730,312 | A | | 3/1998 | Hung | |
| 6,105,859 | A | | 8/2000 | Stafford | |
| 6,123,215 | A | | 9/2000 | Windle | |
| 6,126,031 | A | | 10/2000 | Reason | |
| 6,568,555 | B1 | | 5/2003 | LoCascio | |
| 7,036,675 | B2 | | 5/2006 | Forest | |
| 7,093,737 | B2 | * | 8/2006 | Tramontina et al. | 221/46 |
| 2004/0217121 | A1 | * | 11/2004 | Geyer | 221/33 |

FOREIGN PATENT DOCUMENTS

| | | | | |
|---|---|---|---|---|
| GB | 2079249 | A | * | 1/1982 |
| GB | 2266446 | A | | 11/1993 |

* cited by examiner

*Primary Examiner* — Bryon Gehman
*Assistant Examiner* — Shawn Braden
(74) *Attorney, Agent, or Firm* — Harold I. Masteller

(57) ABSTRACT

A waste management system comprising a trash receptacle, a pouch fixed to a surface of the trash receptacle and including a clasp means, and a cartridge with an arrangement of retainer slots. The retainer slots are positioned to correspond with the clasp means when the cartridge is inserted into the pouch so that the retainer slots are penetrated by the clasp means. The cartridge contains a plurality of liners hung from a support member within said cartridge, the hung liners positioned for distribution through a combination longitudinal notch and transverse slit provided in the cartridge.

5 Claims, 15 Drawing Sheets

Fig. 1
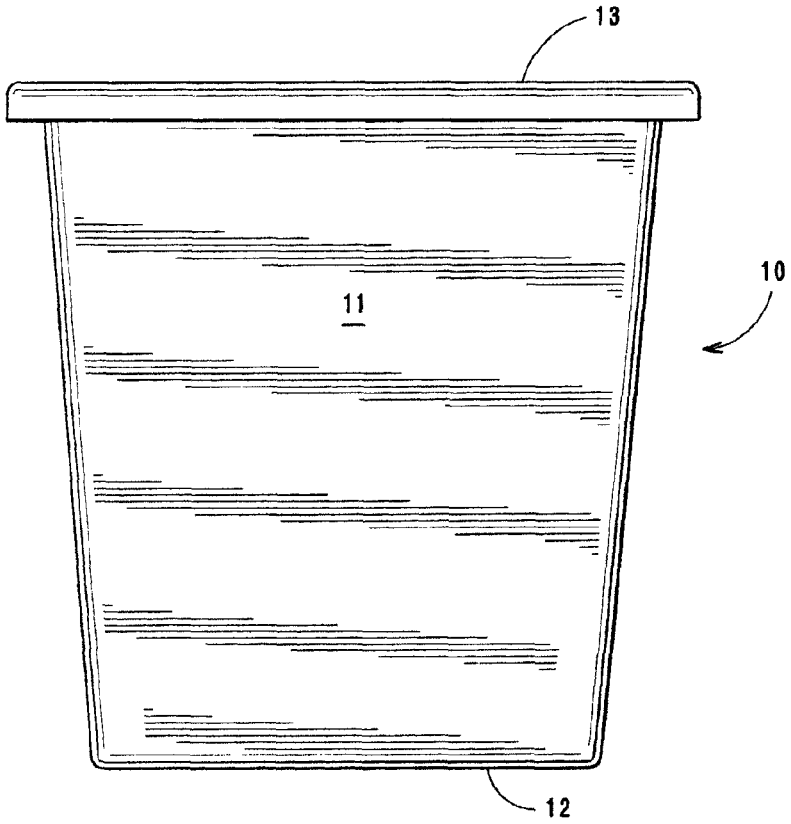
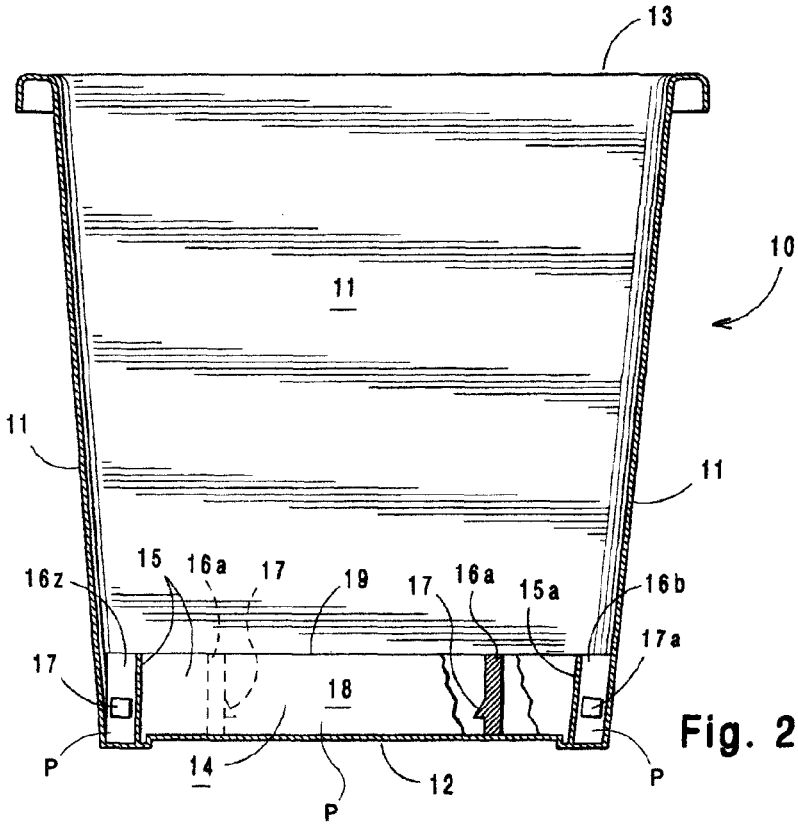
Fig. 2

Fig. 17
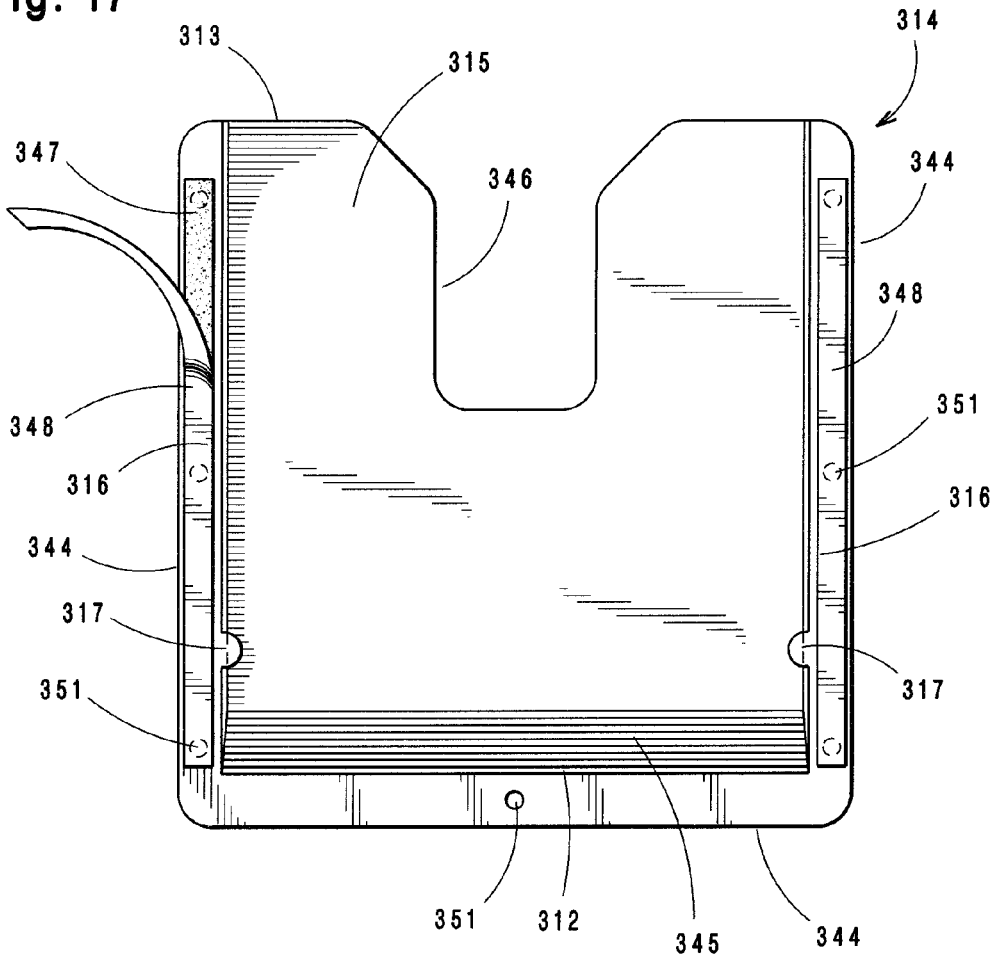
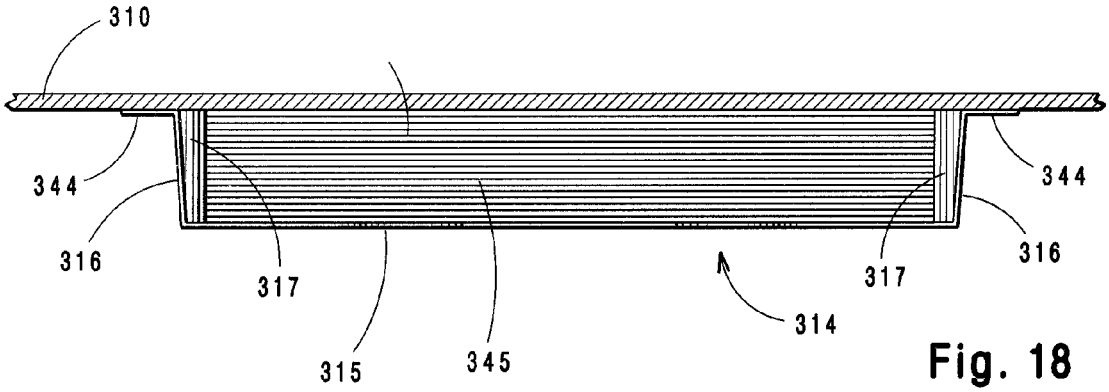
Fig. 18

Fig. 22
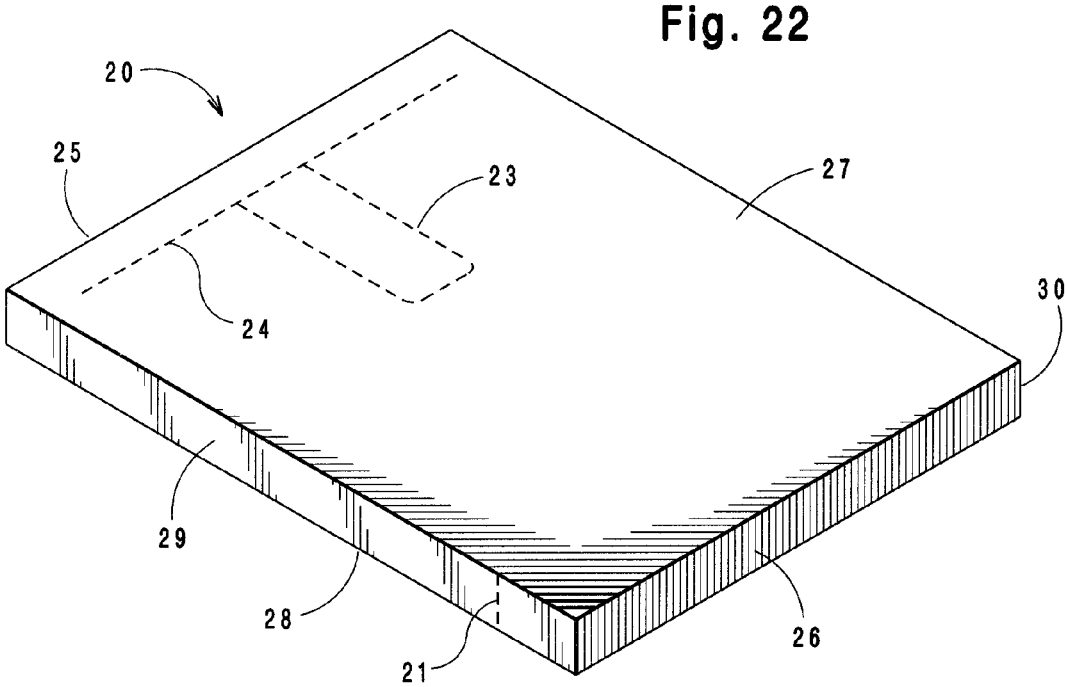
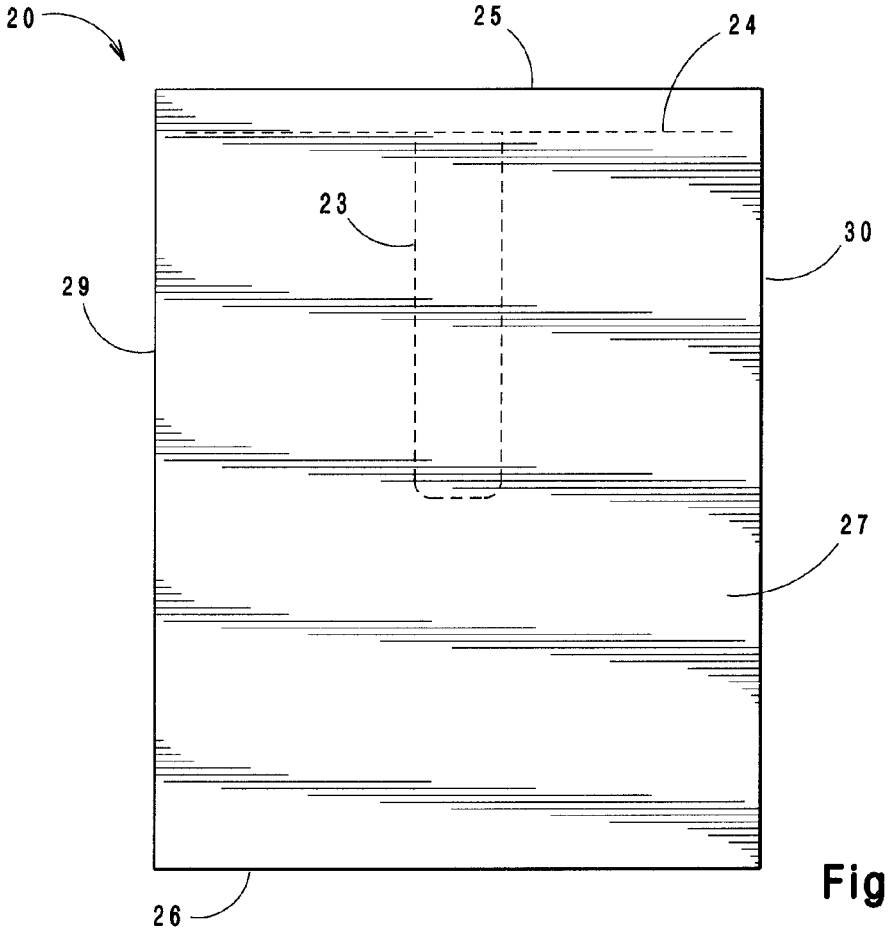
Fig. 23

Fig. 24
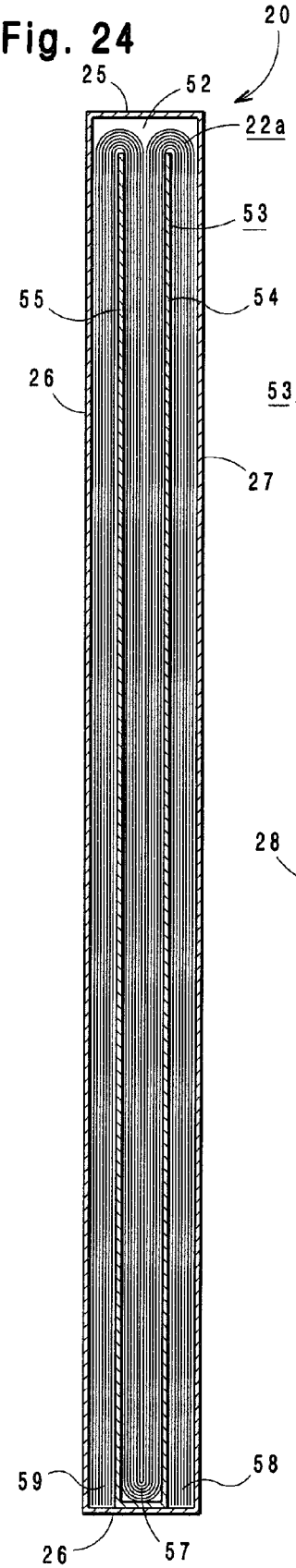
Fig. 25
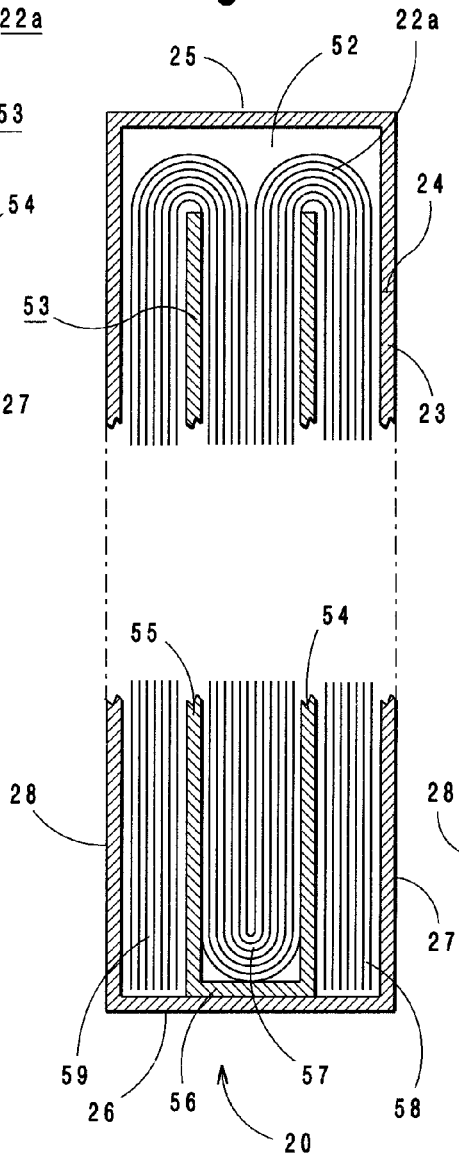
Fig. 26
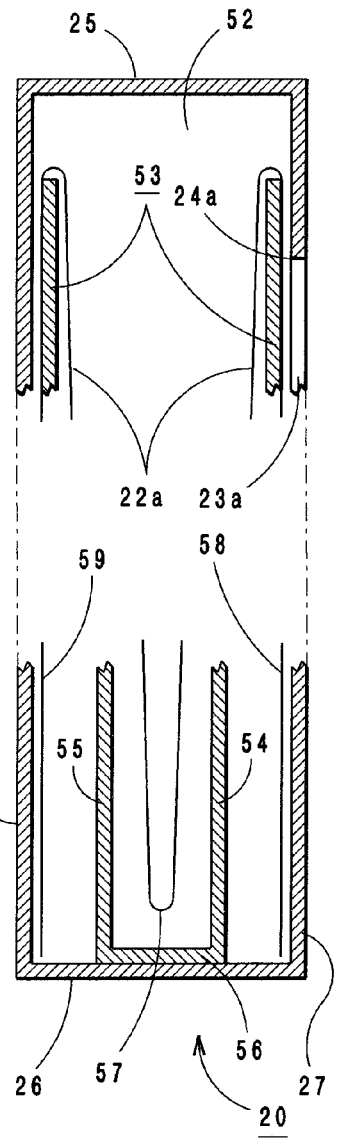
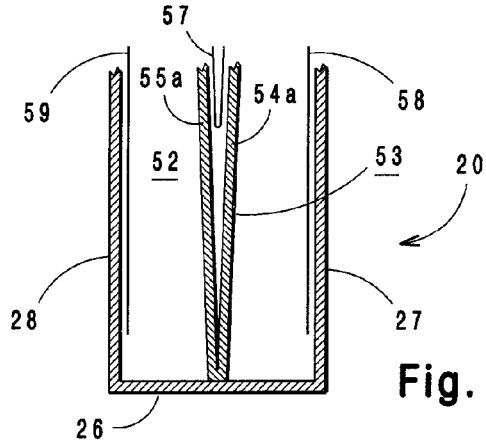
Fig. 26A

Fig. 27
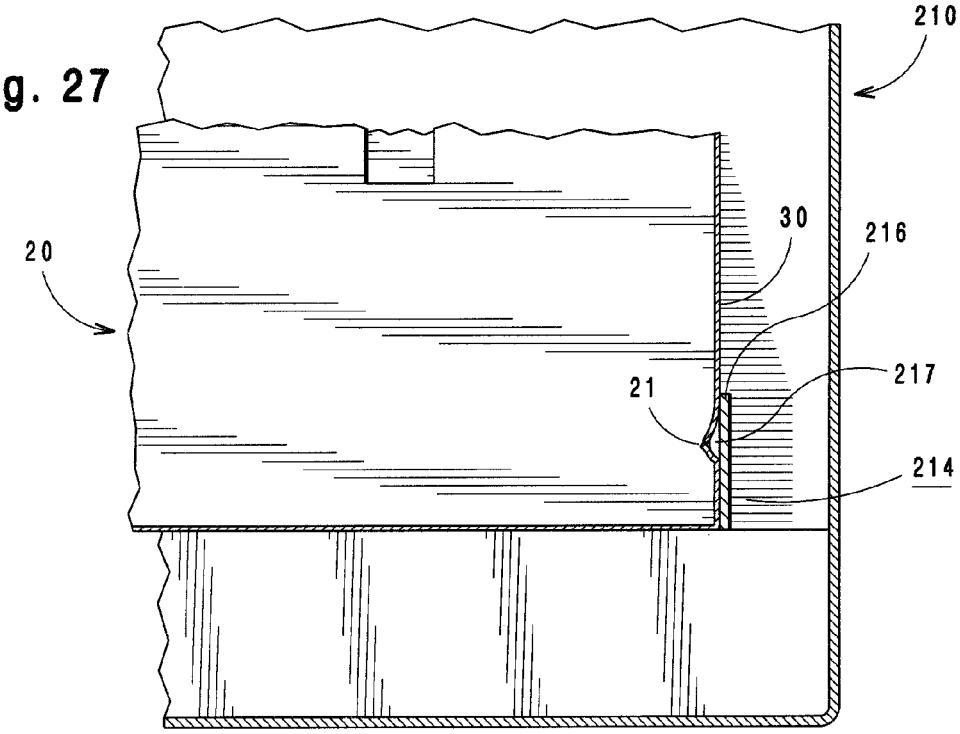
Fig. 28
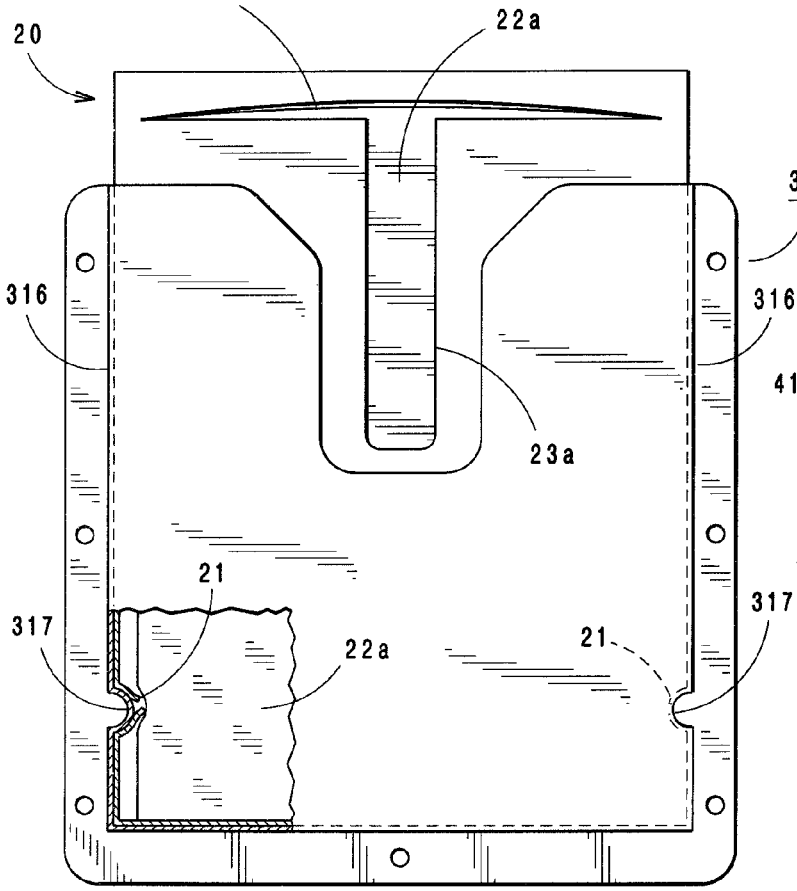
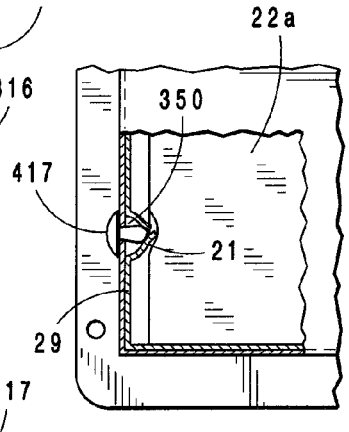
Fig. 29

APPARATUS AND SYSTEM FOR WASTE MANAGEMENT

BACKGROUND

This application is a continuation-in-part of the following applications: (1) U.S. application Ser. No. 11/067,215 filed Feb. 25, 2005 now abandoned, (2) U.S. application Ser. No. 11/318,357 filed Dec. 22, 2005, (3) U.S. application Ser. No. 11/358,013 filed Feb. 21, 2006, and (4) U.S. application Ser. No. 11/412,234 filed Apr. 25, 2006.

The present invention is directed to the collection and disposal of waste materials such as garbage and trash, and in particular, it is directed to a waste management system that includes a combination trash receptacle, pouch, and cartridge that contains a supply of plastic liners or bags for use within the receptacle.

Trash receptacles or cans are often fitted with a plastic liner for sanitation purposes and for convenience when disposing of the collected waste. Therefore, it is desirable to have replacement bags stored within easy reach of the trash receptacle to provide ready access to a new liner after a filled liner is removed from the trash receptacle. Various means for providing such ready access are shown in the prior art. For example, U.S. Pat. No. 6,123,215 granted to Windle on Sep. 26, 2000, discloses a dispenser attached to an outside surface of a trash container for storing a plurality of liners. Windle provides ready access to liners. However, it is difficult to remove a single liner from a stack of stored liners. Absent a liner retention means, when a liner is pulled from the dispenser, more often than not, a plurality of stored liners is removed from the dispenser. As a result, the unwanted liners are stuffed back into the dispenser making the next single liner removal more difficult.

U.S. Pat. No. 5,671,847 granted to Pedersen et al. on Sep. 30, 1997, overcomes the single liner removal problem associated with Windle by providing a dispenser containing a continuous strip of perforated liners. However, the Pedersen et al. dispenser is placed in the bottom of a trash container where it is exposed to liquids that may seep into the bottom of the container. Such placement creates unpleasant conditions when replacements are pulled from the dispenser. In addition, when pulled from a dispenser, a continuous strip of perforated liners often do not separate along the perforations, and more often than not, more than one liner is pulled from the dispenser. In such an event, the additional length of liners falls to the container bottom where it is coated with collected liquids.

Gola overcomes the problem of liners being exposed to undesirable liquids in U.S. Pat. No. 5,628,424 granted on May 13, 1997. The patent discloses a trash container having a bottom panel attached to base portion that dispenses either a continuous strip of perforated liners or a box of individual bags. The bottom panel is sloped upward to a slot through which the stored liners are dispensed, and the sloped surface prevents liquids from seeping into the base portion where the liners are stored. However, it is well known that stacked items, for example tissues dispensed from a tissue box, or the like, often do not withdraw a portion of the next item when used. In such an instance, when a portion of the next liner is not pulled through the dispenser slot, complicated rethreading of stored liners must be completed to make the Gola dispenser operable.

BRIEF SUMMARY OF THE INVENTION

It is therefore the first object of the present invention to provide a waste management system that always dispenses a single liner and always places a replacement liner at a ready access position.

It is another object of the present invention to provide a cartridge containing a supply of liners arranged on a support means so that a single liner is always dispensed from the cartridge and a replacement liner is always positioned for ready access.

It is another object of the present invention to provide a pouch attached to a surface of a trash receptacle, the pouch adapted to receive the cartridge containing a supply of liners.

It is another object of the present invention to provide a clasp means that releasably fixes the cartridge containing a supply of liners within the pouch and prevents accidental cartridge removal when a liner is dispensed.

It is another object of the present invention to provide a trash receptacle with a reservoir that isolates collected liquids from the pouch and cartridge.

Specifically this invention is a waste management system that provides a combination trash receptacle, pouch, and liner supply cartridge that always dispenses a single liner for use within the trash receptacle.

One aspect of the present invention is a pouch that is fixed to a desired surface of the trash receptacle by the user.

Another aspect of the present invention is an integrated pouch and trash receptacle where the pouch is formed as part of the trash receptacle.

Another aspect of the present invention is an integrated pouch and trash receptacle where the pouch and receptacle walls are formed so that the trash receptacles can be stacked for shipping or storing.

Another aspect of the present invention is an integrated pouch and trash receptacle where the pouch includes a continuous wall that defines a reservoir for collecting liquids.

Another aspect of the present invention is an integrated pouch and trash receptacle where the trash receptacle includes a stepped or offset bottom that provides a reservoir for collecting liquids.

BRIEF DESCRIPTION OF THE DRAWINGS

FIG. 1 is an elevation view of the preferred trash receptacle used in the present waste management system.

FIG. 2 is a cross-section view through the trash receptacle shown in FIG. 1.

FIG. 17 is a back elevation view of an alternate embodiment pouch that is fixed to a desired surface of the trash receptacle by a user.

FIG. 18 is a top plan view of the alternate pouch shown in FIG. 17.

FIG. 22 is an isometric view showing the preferred embodiment of the liner cartridge used in the present waste management system.

FIG. 23 is a front elevation view of the cartridge shown in FIG. 22.

FIG. 24 is a transverse cross-section view taken through the liner cartridge shown in FIG. 23.

FIG. 25 is an enlarged cross-section view of the cartridge filled with a plurality of liners.

FIG. 26 is an enlarged cross-section view of the cartridge with a single remaining liner.

FIG. 26A is a cross-section view of the cartridge with an alternate support member.

FIG. 27 shows the preferred clasp means for releasably fixing the liner cartridge within a pouch used in the present waste management system.

FIG. 28 shows an alternate clasp means for releasably fixing the cartridge within a pouch.

FIG. 29 shows another alternate clasp means for releasably fixing the cartridge within a pouch.

DETAILED DESCRIPTION OF THE INVENTION

The present invention includes a waste management system having a combination trash receptacle, pouch, and liner cartridge that always dispenses a single liner for use within the trash receptacle and always positions a replacement liner at ready access.

As used herein, the term "clasp," includes prongs or detents formed within a pouch adapted to releasably fix a liner cartridge, or to a removable fastener inserted through walls or panels that define the pouch to releasably fix a liner cartridge.

The term "pouch" as used herein is a structure integral with the trash receptacle used in the present waste management system or a separate structure fixed to a selected surface of the trash receptacle and adapted to receive the liner cartridge of the present invention.

The term "liner support" as used herein refers to a structure, housed within the liner cartridge that maintains replacement liners at a proper position for distributing a replacement liner.

Figure 3:
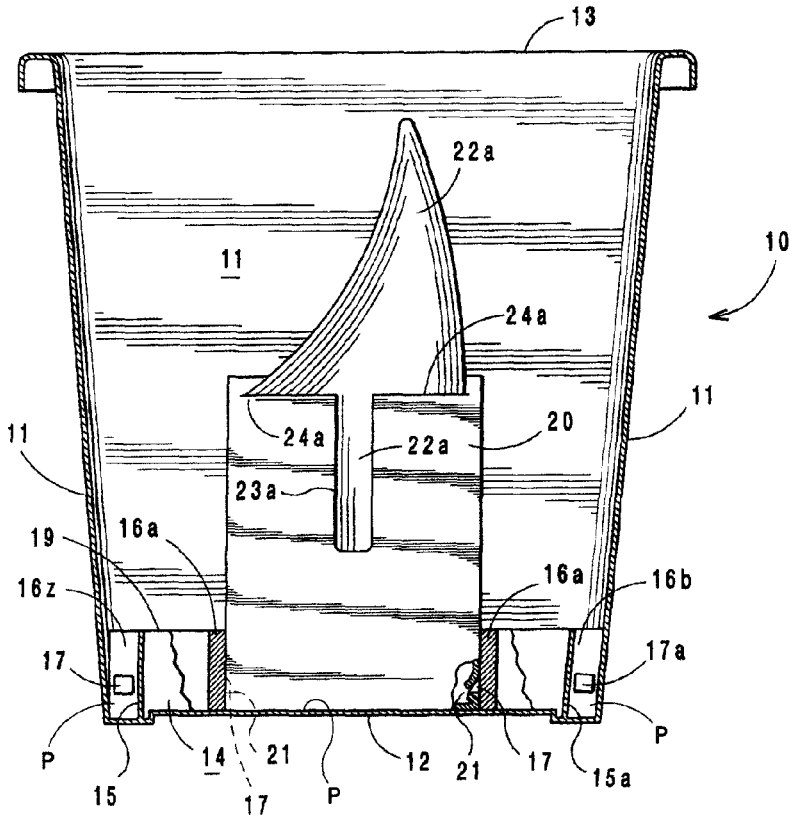
FIG. 3 is a cross-section view similar to FIG. 2 showing the cartridge used in the present waste management system removably fixed within the integrated pouch portion of the trash receptacle.

Referring to FIGS. 1 through 7, the preferred trash receptacle 10 of the present waste management system comprises a continuous wall 11 extending between a closed end 12 and an open end 13. A lid assembly, not shown, can be provided at the open end without departing from the scope of the present invention. The closed end 12 includes a pouch assembly 14 that provides at least one pouch "P" formed as an integral part of receptacle 10. The pouch assembly 14 includes a continuous front panel 15 and one or more pairs of sidewalls 16a through 16*z* that extend between wall 11 of the trash receptacle and the front panel 15 of the pouch assembly; the combination continuous front panel 15 and one or more pairs of sidewalls 16*a* through 16*z* defining one or more pouches "P". As illustrated in FIG. 3, and also referring to FIG. 22 showing an isometric view of the liner cartridge 20 of the present invention, each pair of sidewalls, 16*a* through 16*z* are spaced apart at a distance that corresponds with the width of liner cartridge 20, and each sidewall includes an inward extending clasp 17 positioned to correspond with a perforated retainer slot 21 provided in the liner cartridge so that when a cartridge 20 is inserted into one of the pouches "P" the corresponding clasp 17 penetrates through the perforated slot 21 and fixes cartridge 20 within pouch "P".

Figure 4:
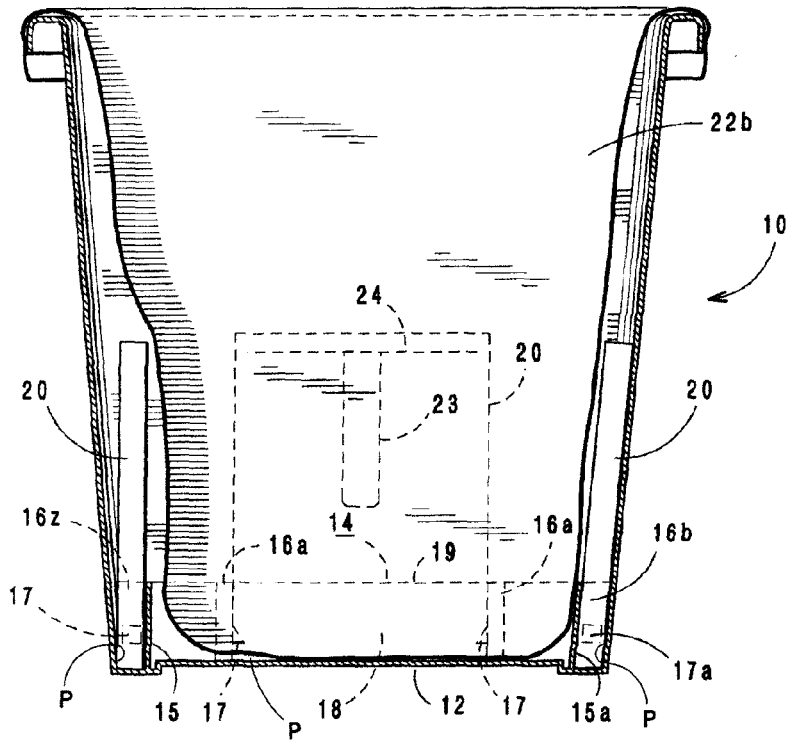
FIG. 4 is a cross-section view similar to FIG. 3 showing a liner dispensed from the cartridge and inserted into the trash receptacle.

Referring to FIGS. 2, 3, and 4, the pouch assembly front panels 15, clasps 17 and sidewalls, for example sidewall 16*z*, may either be positioned at an angle to the continuous wall 11 of the trash receptacle, or positioned parallel to continuous wall 11 as shown at sidewall 16*b*, front panel 15*a* and clasp 17*a*. In such a parallel arrangement, the inserted cartridge 20 is held parallel against the continuous wall. This provides a larger volume or space within the trash receptacle for trash collection as compared to the angled pouch assembly at sidewall 16*z*, it stabilizes the cartridge and reduces unintentional cartridge removal when a filled liner is removed for disposal, it reduces the possibility of ripping or tearing the liner 22*b* during disposal, and it provides an increased reservoir size for collecting seepage.

Figure 7:
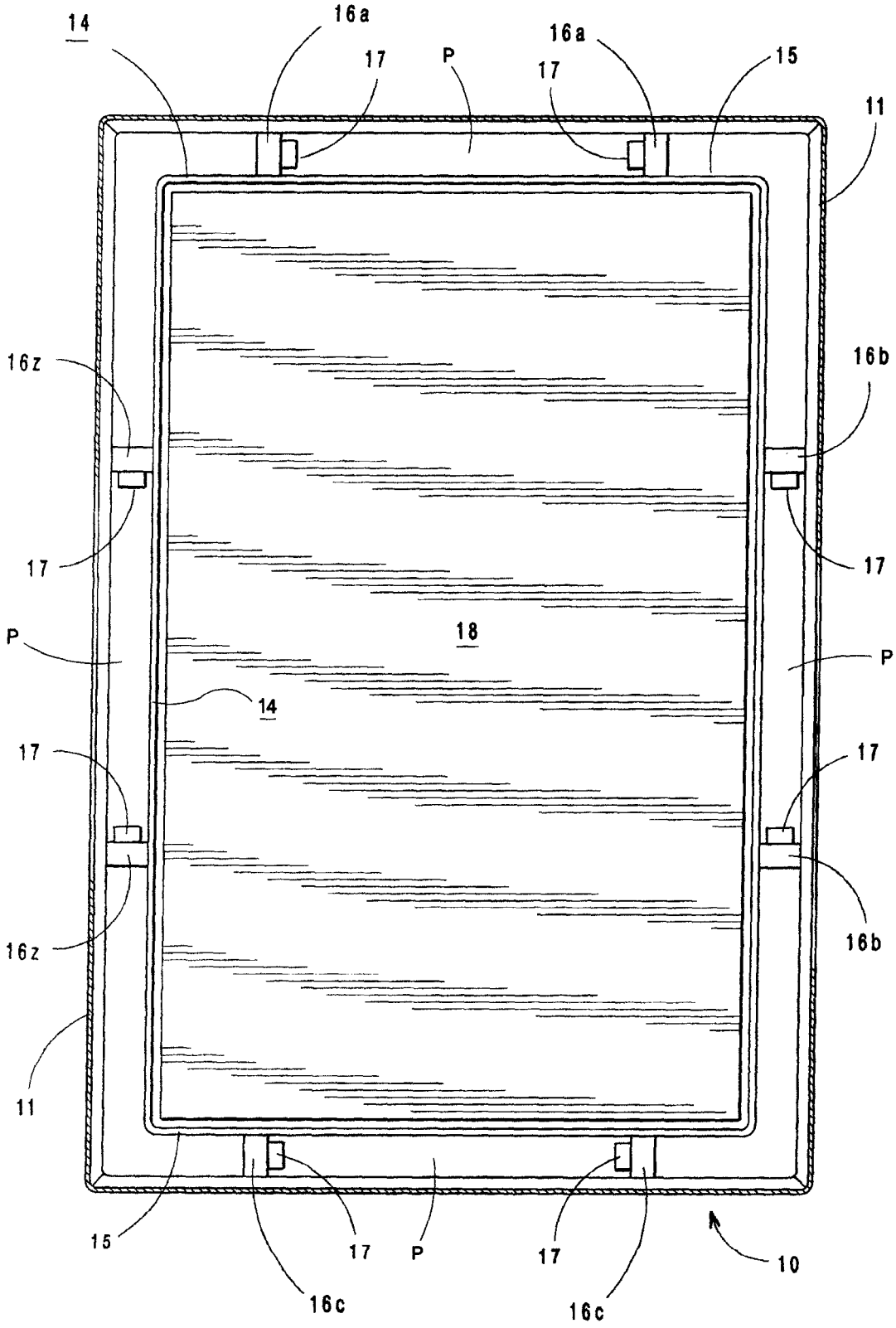
FIG. 7 is a top plan view showing the interior portion of the trash receptacle in FIG. 1.
Figure 8:
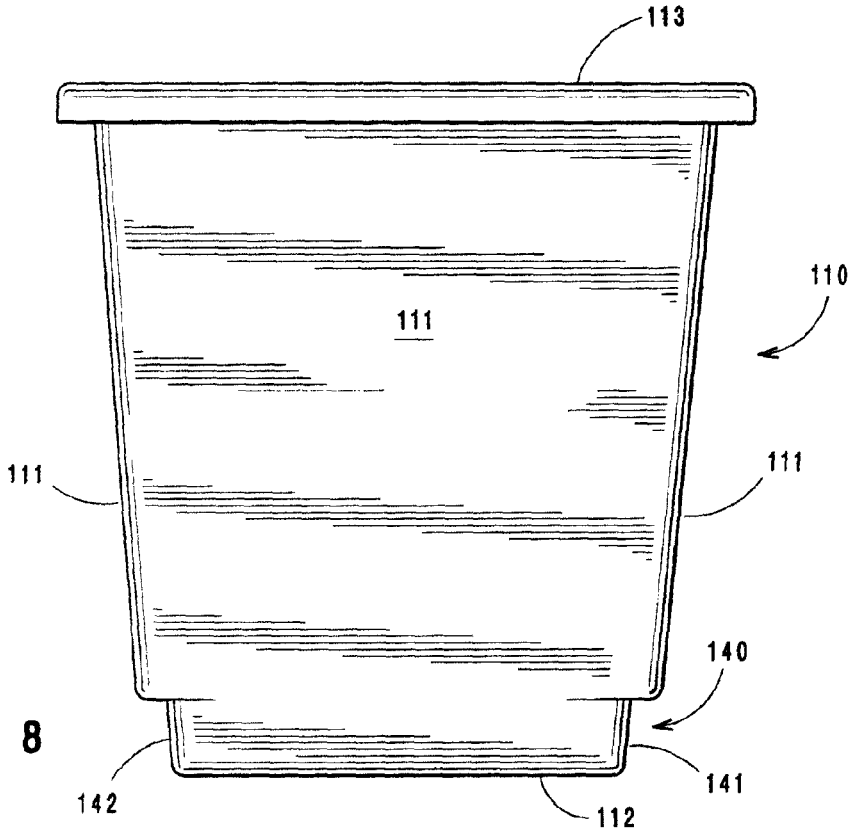
FIG. 8 is an elevation view of an alternate embodiment of a trash receptacle used in the present waste management system.

Referring to FIG. 7, the preferred pouch assembly includes four pairs of sidewalls 16*a* through 16*z* to provide four pouches "P". However, it should be understood that any number of sidewall pairs may be provided without departing from the scope of the present invention. In the preferred embodiment, up to four liner cartridges may be stored within the trash receptacle 10, or a single liner cartridge may be stored between a selected pair of sidewalls that is most convenient for the user.

Referring to FIGS. 8 through 13, showing an alternate embodiment of a trash receptacle 110 suitable for use with the present waste management system, the receptacle 110 comprises a continuous wall 111 extending between a closed end 112 and an open end 113. As before, a lid assembly, not shown, can be provided at the open end without departing from the scope of the present invention. The alternate trash receptacle embodiment includes a stepped portion 140 that includes at least two front panels 115 positioned inboard of the continuous wall 111, opposite each other, and extend in an upward direction from the closed end 112 of the trash receptacle. It should be understood that the stepped portion 140 could comprise four opposed sidewalls positioned along each side and inboard of the continuous wall 111 without departing from the scope of the present invention. At least one pouch "P", formed as an integral part of receptacle 110, comprise a front panel 115 and a pair of sidewalls 116 that extend between the continuous wall 111 of the trash receptacle and the front panel 115. Each pair of sidewalls 116 is spaced apart at a distance that corresponds with the width of liner cartridge 20 so that each inward extending clasp 117 is positioned to correspond with and penetrate a perforated retainer slot 21 in the liner cartridge as illustrated in FIG. 27. The opposed clasps 117 releasably fix liner cartridge 20 between the spaced apart sidewalls 116.

Referring again to FIG. 3, liner cartridge 20 contains a plurality of replacement liners 22*a* that are folded along the length and width to fit the space provided within cartridge 20. The liners are preferably made of a plastic material; however, any suitable material may be used to manufacture the liners without departing from the scope of the present invention. Liner cartridge 20 includes a perforated longitudinal notch 23 that intersects a perforated transverse slit 24 to provide access to the replacement liners 22*a* after the perforated sections are opened. The opened notch 23*a* enables a user to grasp a replacement liner 22*a* and pull it from the cartridge while the opened perforated slit 24*a* provides an opening having sufficient width and tightness to slip the folded liner 22*a* from cartridge 20, and at the same time, prevent the next replacement liner from following the pulled liner. The preferred liner cartridge 20 is described in greater detail below.

As shown in FIGS. 3 and 4, the continuous front panel 15 of pouch assembly 14 defines a reservoir area 18 along the closed end 12. When the unfolded liner 22*b* is placed within the trash receptacle 10, its closed end is placed within reservoir 18 to contain any liquids that may seep from liner 22*b* into receptacle 10. Reservoir 18 isolates the stored liner cartridges 20 from the seepage and prevents contact with the unpleasant liquids. FIG. 4 shows two liner cartridges 20 stored within the pouch assembly 14 between the pairs of sidewalls 16*a* and 16*z*. The perforated notch 23 and perforated slit 24 in the liner cartridge between the pair of sidewalls 16*a* have not yet been opened.

Figure 6:
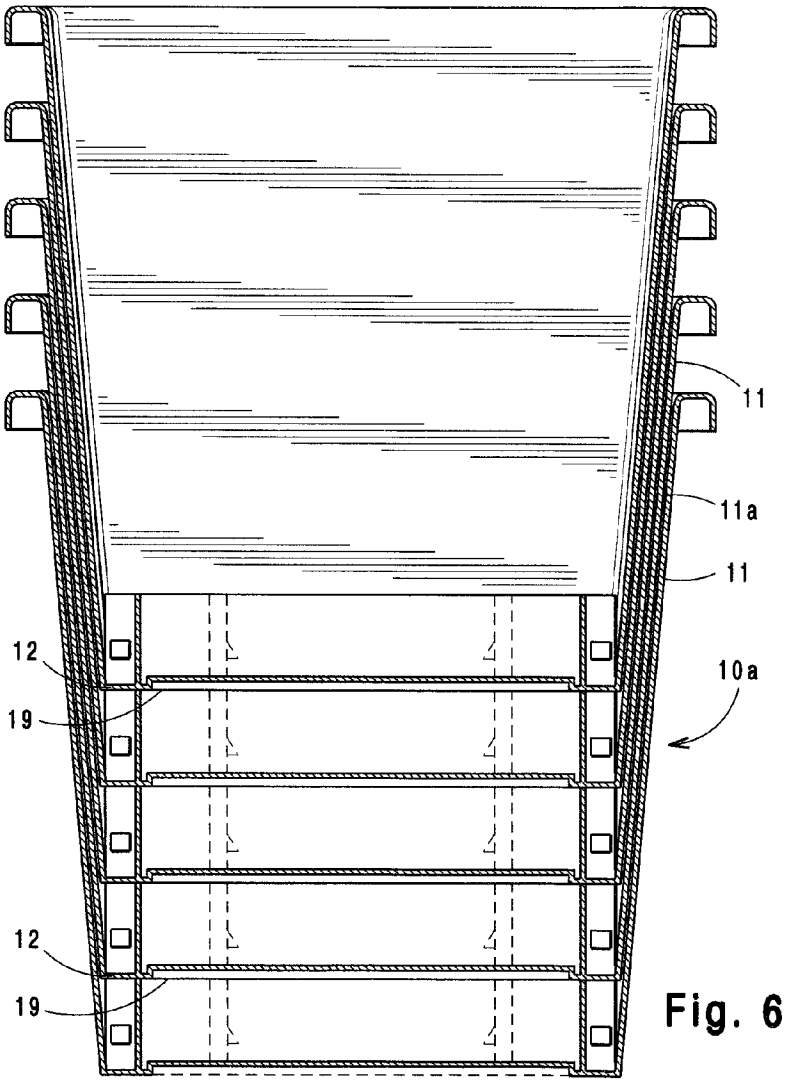
FIG. 6 is a cross-section view similar to FIG. 5 showing an arrangement of stacked trash receptacles for shipping or storage.
Figure 5:
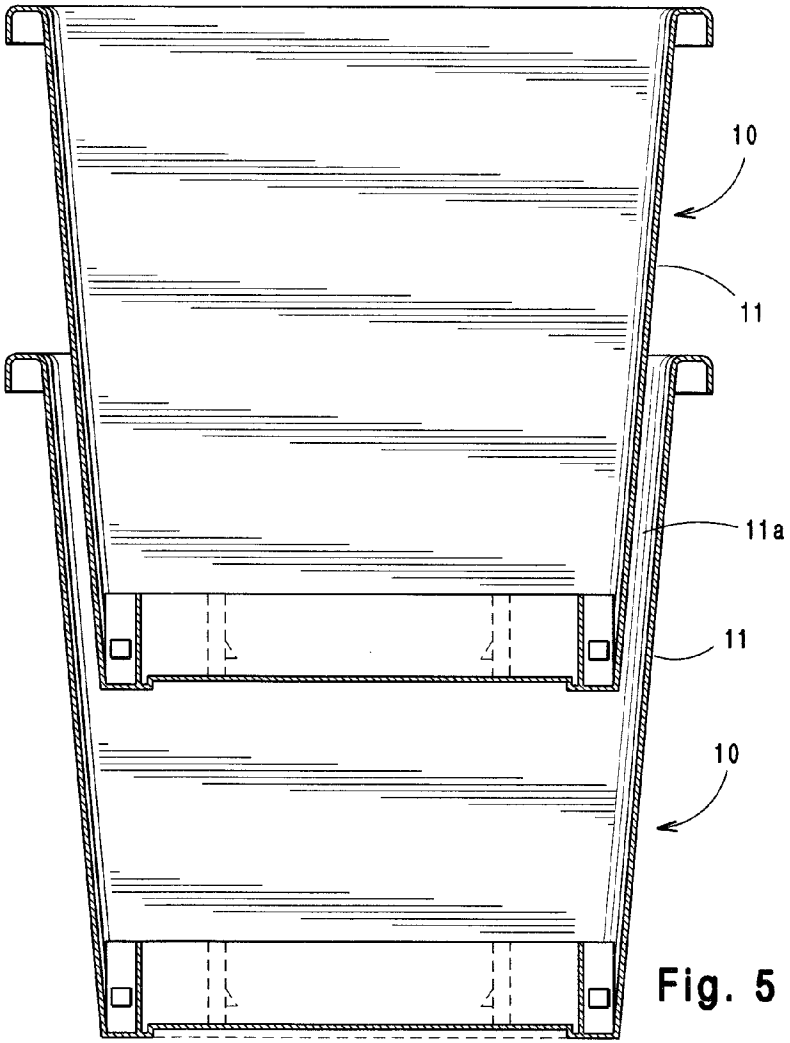
FIG. 5 is a cross-section view similar to FIG. 2 showing a second trash receptacle being inserted into a first trash receptacle.

Referring to FIGS. 5 and 6, the continuous wall 11, associated with the trash receptacle 10, is tapered or sloped in an inward direction from the open end 13 toward the closed end 12 so that the receptacles 10 can be inserted into each other, as shown in FIG. 5. This enables stacking a plurality of receptacles 10*a* for storage or shipping as shown in FIG. 6. When the trash receptacles 10*a* are stacked, the top edge 19 of the pouch assembly front panel 15 supports the bottom end 12 of an inserted receptacle. This maintains the inserted receptacle at an elevated position within the stack 10*a* and provides a gap 11*a* between adjacent walls 11 of the stacked trash receptacles. Gap 11*a* prevents wall to wall contact and facilitates easy removal when the stacked receptacles are separated.

Referring to FIGS. 8 through 13, showing an alternate embodiment of a trash receptacle 110 suitable for use with the present waste management system, the receptacle 110 comprises a continuous wall 111 extending between a closed end 112 and an open end 113. As before, a lid assembly, not shown, can be provided at the open end without departing from the scope of the present invention. The alternate trash receptacle embodiment includes a stepped portion 140 that includes at least two front panels 115 positioned inboard of the continuous wall 111, opposite each other, and extend in an upward direction from the closed end 112 of the trash receptacle. It should be understood that the stepped portion 140 could comprise four opposed sidewalls positioned along each side and inboard of the continuous wall 111 without departing from the scope of the present invention. At least two pouch assemblies 114, formed as an integral part of receptacle 110, comprise an upper portion of each front panel 115 and a pair of sidewalls 116 that extend between the continuous wall 111 of the trash receptacle and the front panel 115. Each pair of sidewalls 116 is spaced apart at a distance that corresponds with the width of liner cartridge 20 so that each inward extending clasp 117 is positioned to correspond with and penetrate a perforated retainer slot 21 in the liner cartridge as illustrated in FIG. 27. The opposed clasps 117 releasably fix liner cartridge 20 between the spaced apart sidewalls 116.

Figure 13:
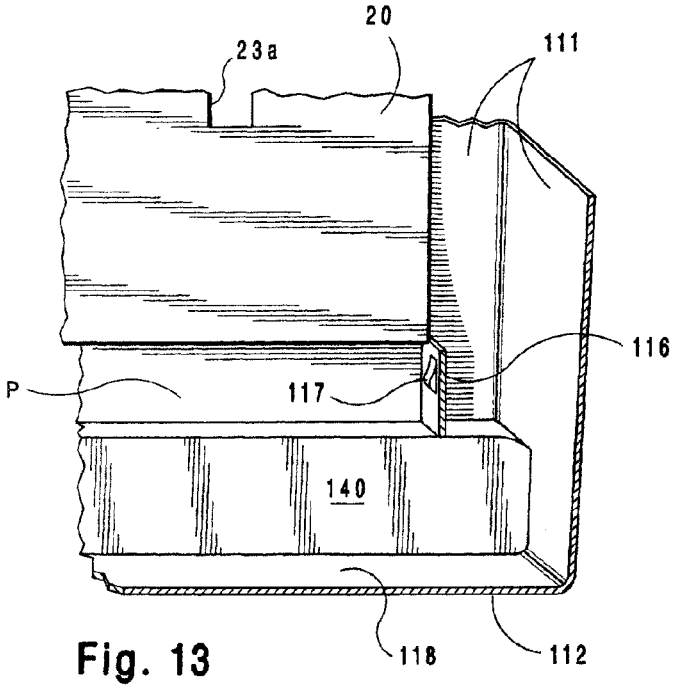
FIG. 13 an enlarged portion of FIG. 12 showing the cartridge being inserted into the integrated pouch portion of the trash receptacle shown in FIG. 8.
Figure 13A:
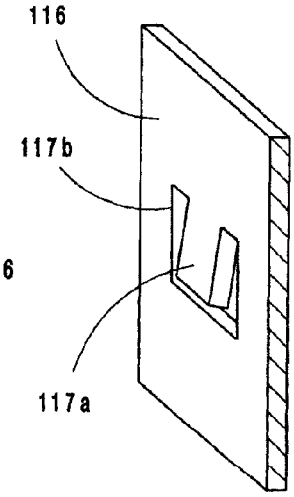
FIG. 13A is an enlarged view of FIG. 13 showing an alternate clasp embodiment.

Referring to FIGS. 13 and 13A, clasps 117 are formed when the trash receptacle is manufactured. However, an alternate clasp 117*a* (FIG. 13A) can be formed as a secondary manufacturing operation by heating and piercing the sidewalls 116 to create a projection or clasp 117*a* within the pierced opening or slot 117*b*.

Figure 9:
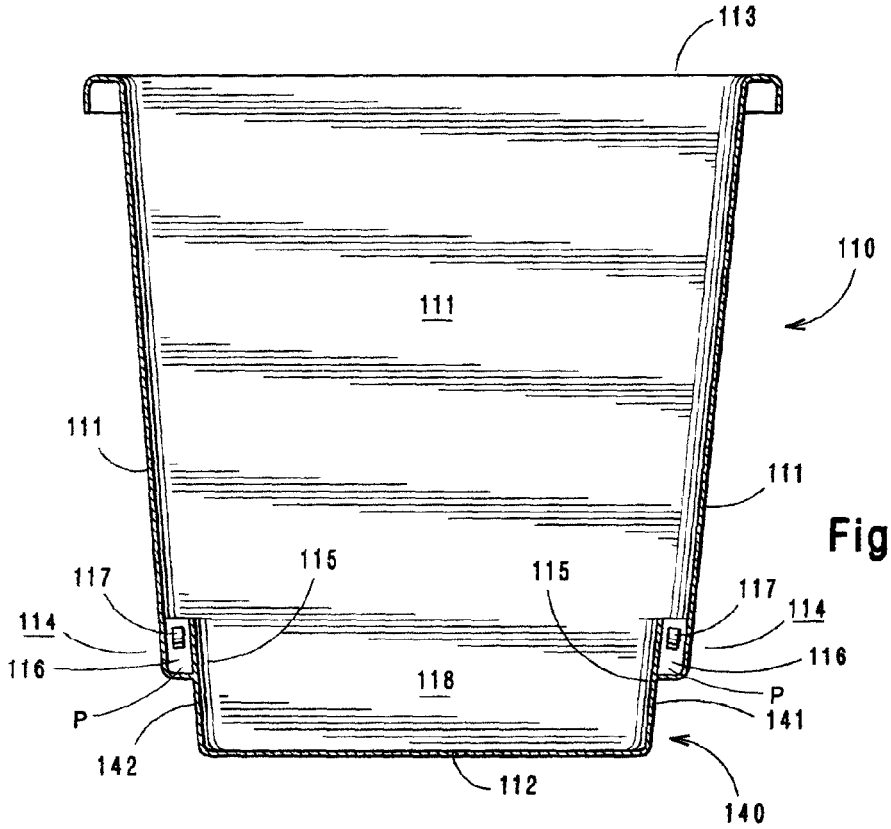
FIG. 9 is a cross-section view through the trash receptacle shown in FIG. 8.

Referring in particular to FIG. 9, the front panels 115 of each pouch assembly 114 define a reservoir area 118 along the closed end 112. When an unfolded liner 22*b*, as illustrated in FIG. 4, is placed in the trash receptacle 110, the closed end of the unfolded liner is placed within reservoir 11. This contains any liquids that may seep from the liner within the reservoir. Reservoir 118 isolates stored liner cartridges from such seepage and prevents contact between the cartridge and unpleasant liquids.

Figure 11:
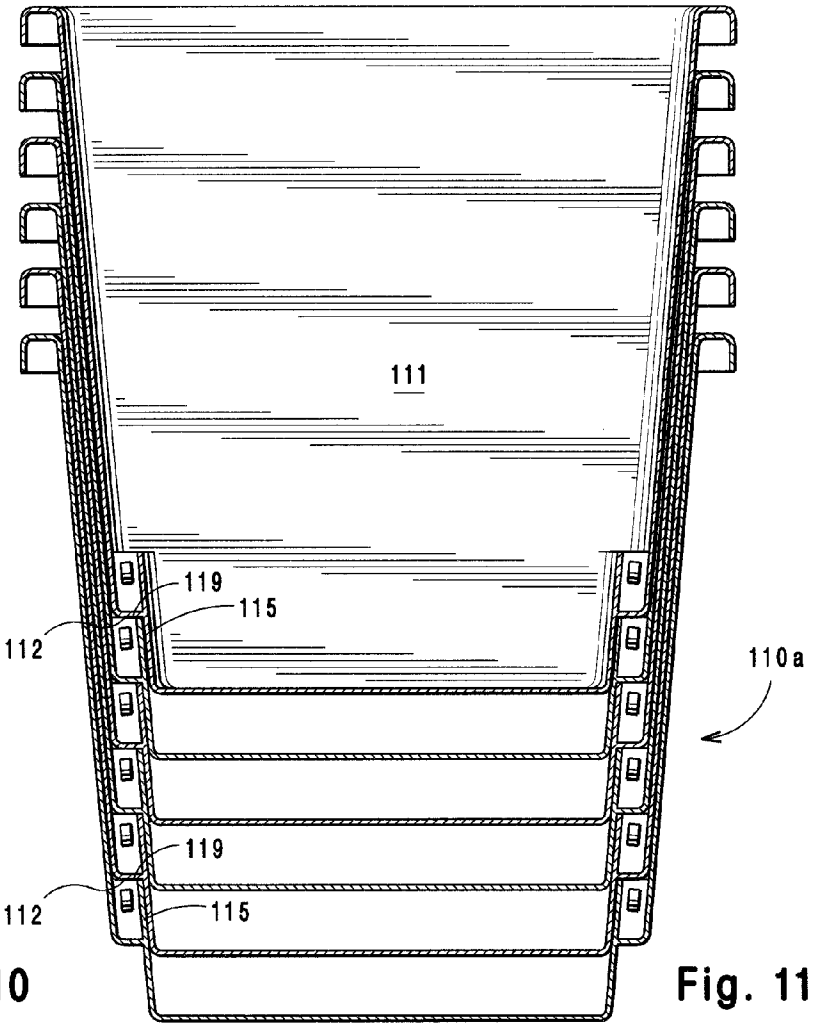
FIG. 11 is a cross-section view similar to FIG. 10 showing an arrangement of stacked trash receptacles for shipping or storage.
Figure 10:
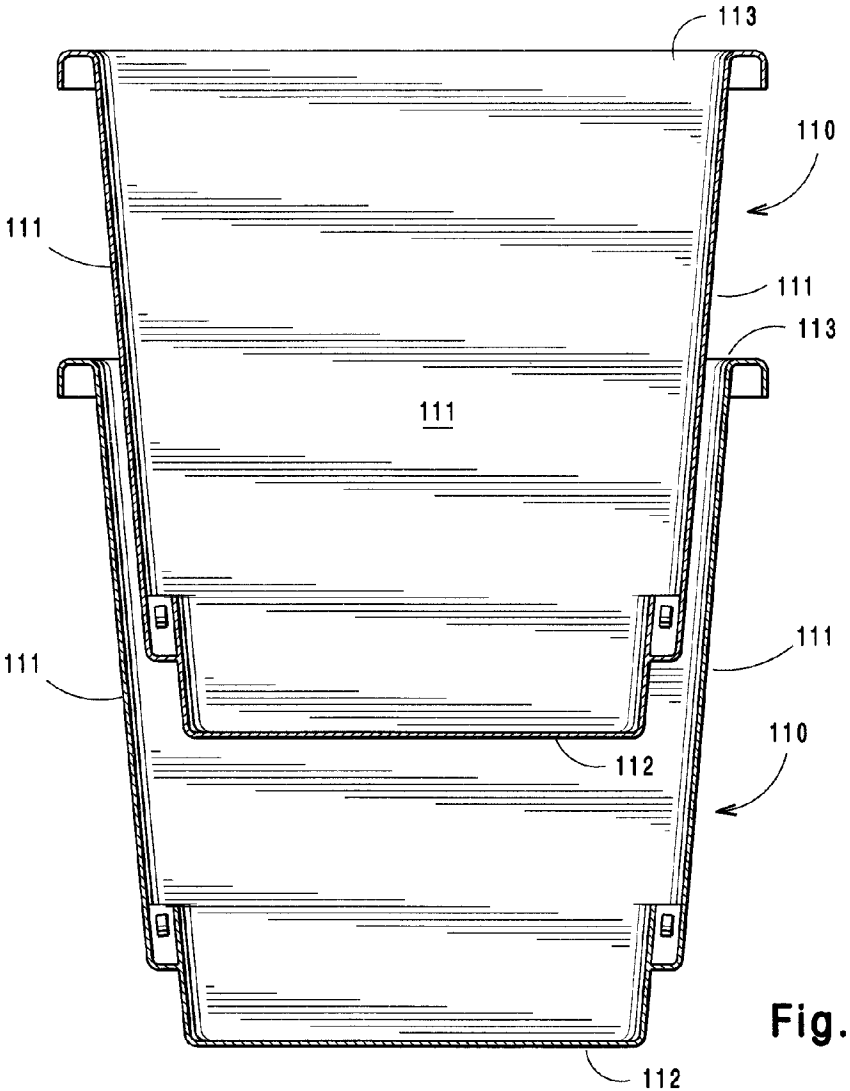
FIG. 10 is a cross-section view similar to FIG. 9 showing a second trash receptacle being inserted into a first trash receptacle.
Figure 12:
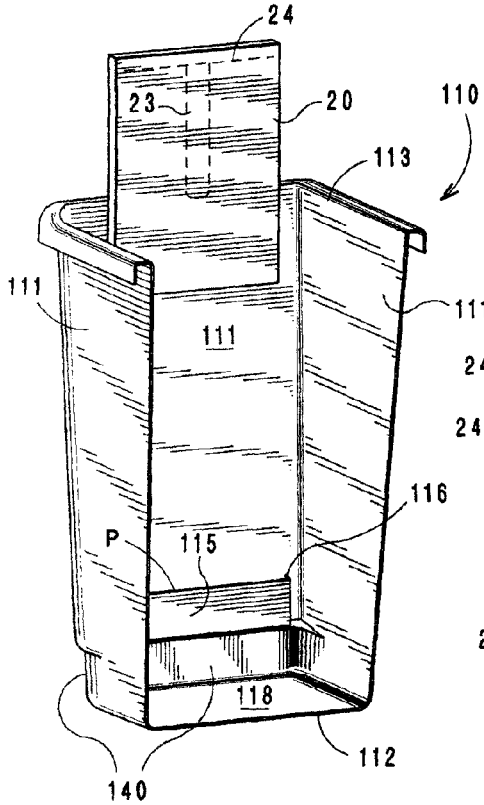
FIG. 12 is a perspective view in cross-section showing a cartridge used in the present waste management system being inserted into the trash receptacle of FIG. 8.

Referring to FIGS. 10 and 11, the continuous wall 111, associated with the trash receptacle 110, is tapered or sloped in an inward direction from the open end 113 toward the closed end 112 so that the receptacles 110 can be inserted into each other, as shown in FIG. 10. This enables stacking a plurality of receptacles 110*a* for storage or shipping as shown in FIG. 11. When the trash receptacles 110*a* are stacked, the top edge 119 of the pouch assembly front panel 115 supports the bottom end 112 of an inserted receptacle and provides a gap similar to FIGS. 5 and 6.

Figure 14:
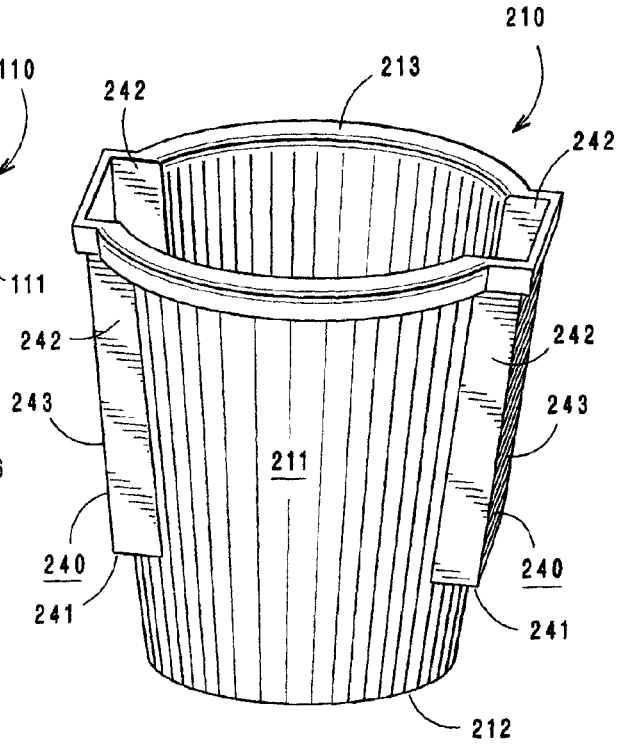
FIG. 14 is a perspective view showing an alternate shaped integrated pouch trash receptacle used in the present waste management system.
Figure 16:
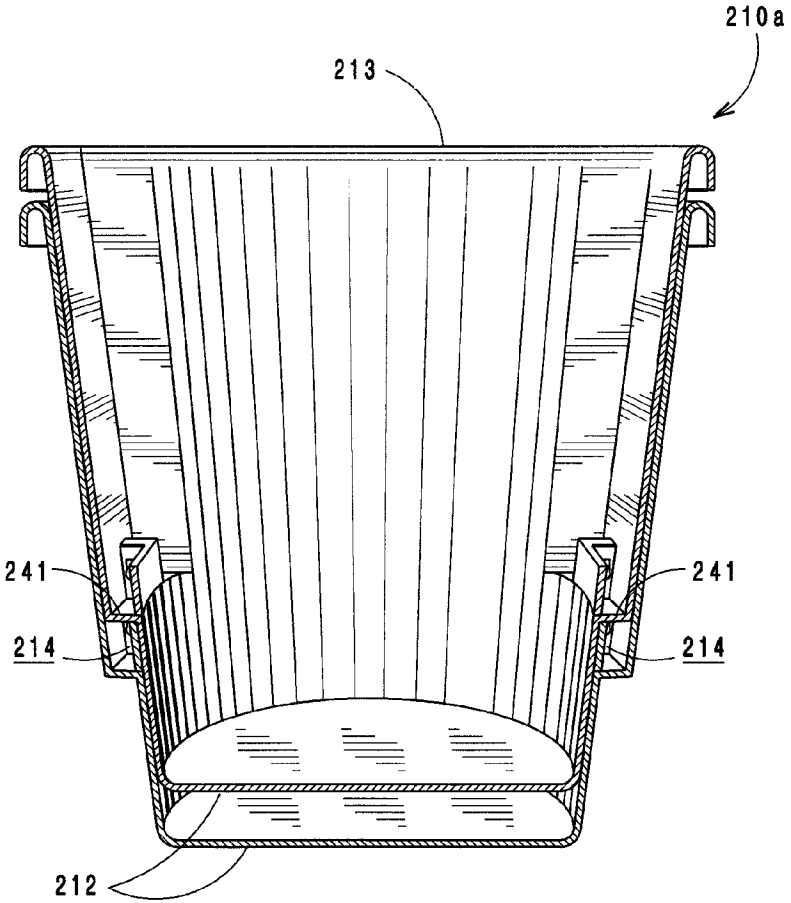
FIG. 16 is a cross-section view similar to FIG. 15 showing an arrangement of stacked trash receptacles for shipping or storage.
Figure 15:
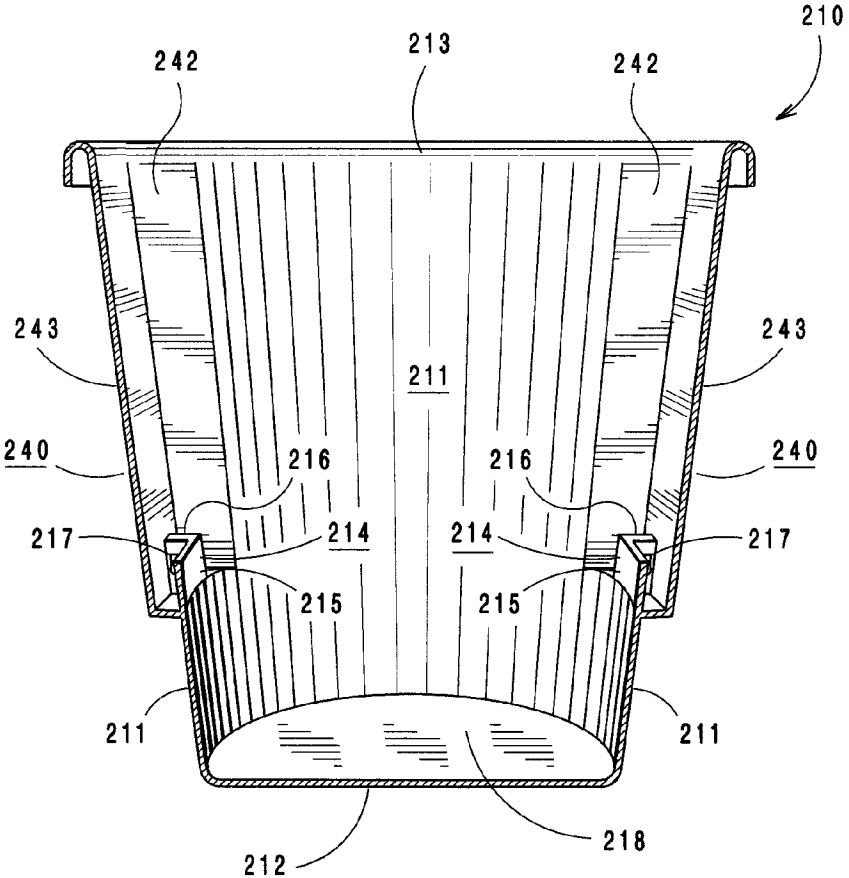
FIG. 15 is a cross-section view through the trash receptacle shown in FIG. 14.
Figure 19:
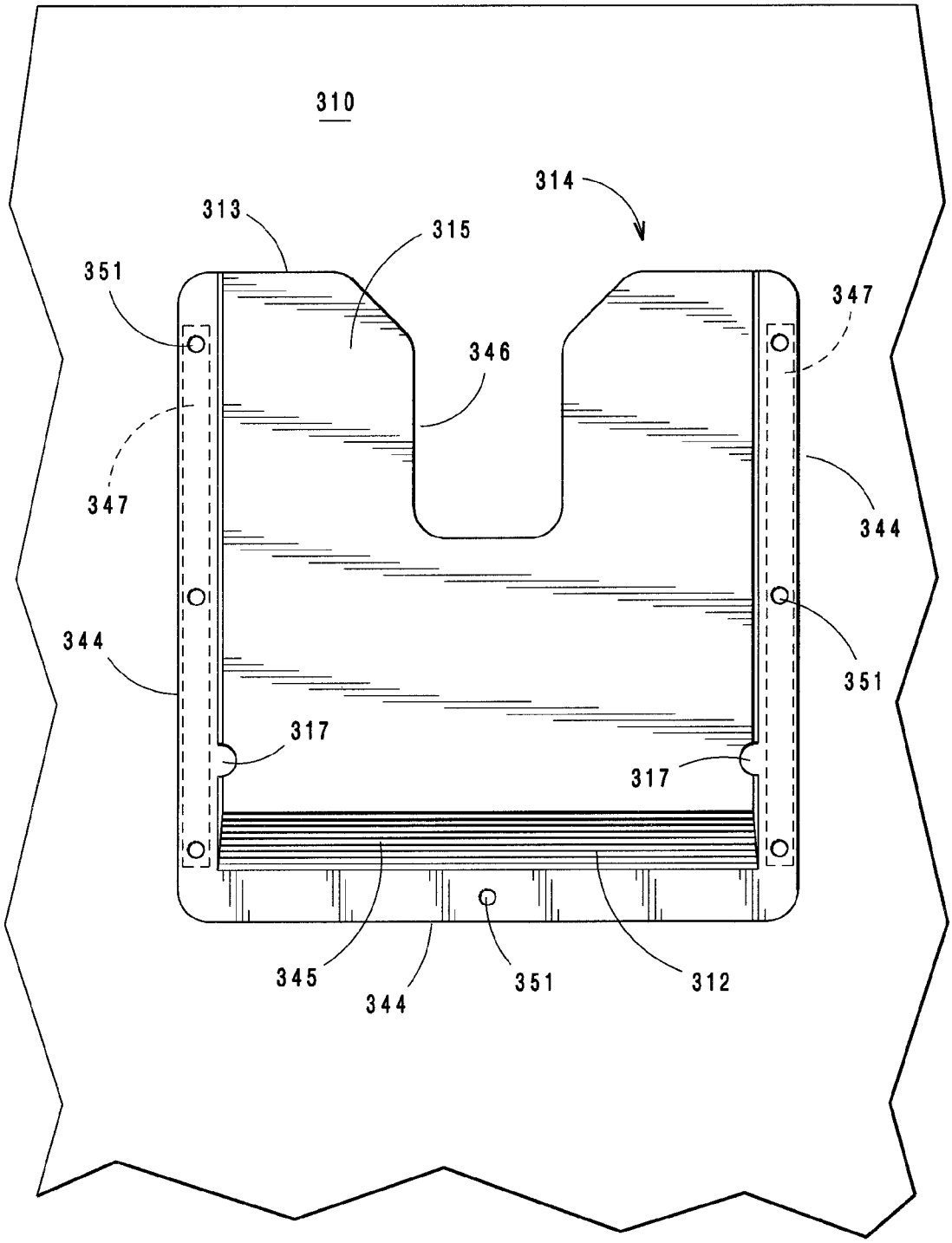
FIG. 19 is a front elevation view of the alternate pouch fixed to a surface of a trash receptacle.
Figure 20:
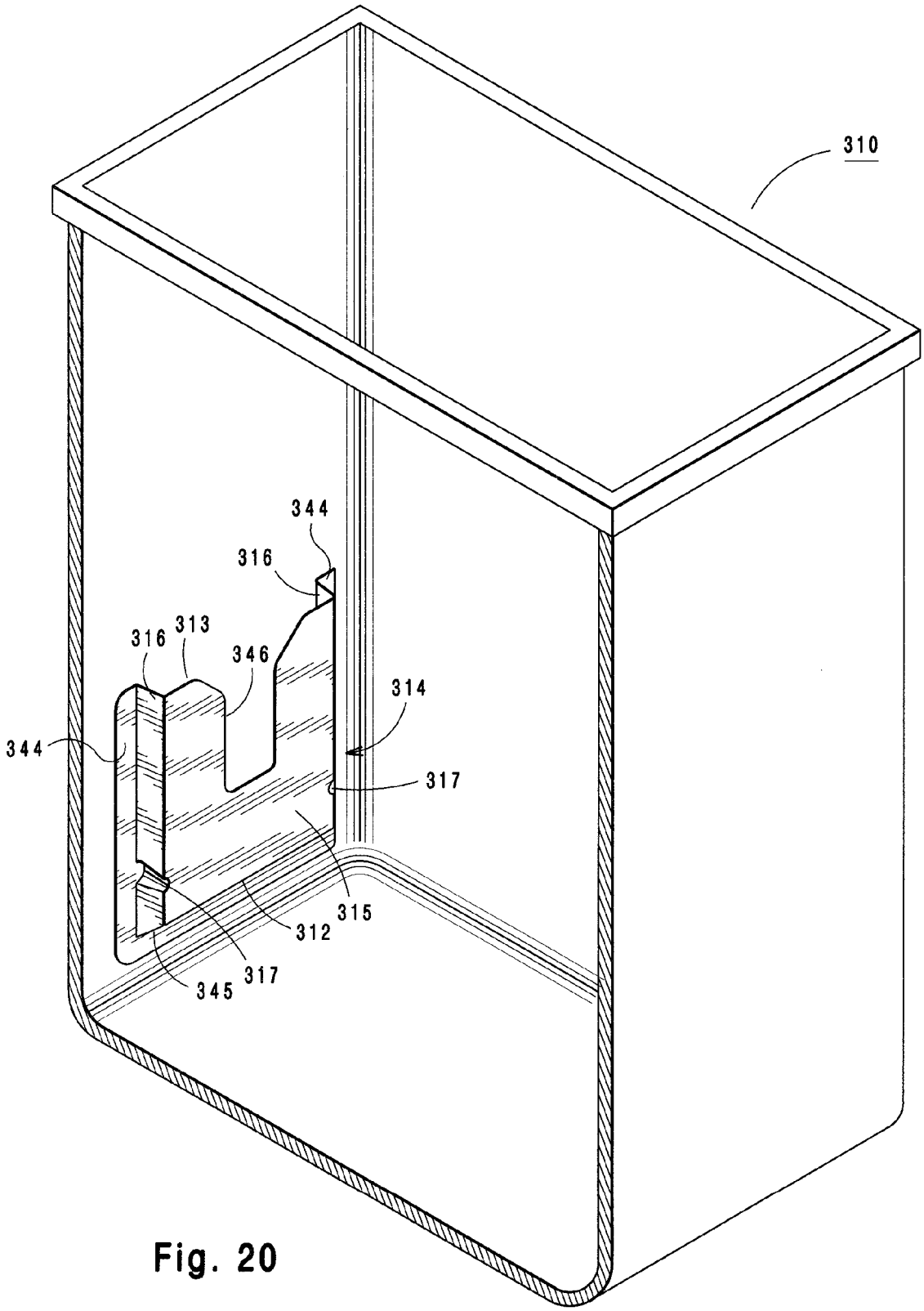
FIG. 20 is an isometric view showing the alternate pouch of FIG. 17 fixed to a lower portion of an inside wall of a trash receptacle used in the present waste management system.

Referring to FIGS. 14, 15, and 16, showing a second alternate embodiment of a trash receptacle 210 suitable for use with the present waste management system, the receptacle 210 comprises a continuous circular or oval wall 211 extending between a closed end 212 and an open end 213. As mentioned in the previous embodiments, a lid assembly, not shown, can be provided at the open end without departing from the scope of the present invention. The second alternate trash receptacle embodiment includes at least two opposed stepped portions 240, each stepped portion having a closed end 241 a pair of side panels 242 that extend outward from the continuous wall 211, and an outboard panel 243 extending between the side panels 242.

At least two pouch assemblies 214, formed as an integral part of the trash receptacle 210, comprise a front panel 215 and a pair of sidewalls 216 to provide pouches "P". Each pair of sidewalls 216 is spaced apart at a distance that corresponds with the width of liner cartridge 20 so that each inward extending clasp 217 is positioned to correspond with and penetrate a perforated retainer slot 21 in the liner cartridge as illustrated in the previous embodiments.

Referring in particular to FIG. 15, the portion of the continuous wall 211 that extends between the pouch assembly 214 and the closed end 212 of the trash receptacle 210 defines a reservoir area 218 along the closed end 212 of the receptacle. When an unfolded liner 22*b*, as illustrated in FIG. 4, is placed within the trash receptacle 210, the closed end of the unfolded liner is placed within reservoir 218 to contain any liquids that may seep from the liner into receptacle 210. Reservoir 218 isolates stored liner cartridges from such seepage and prevents contact between the cartridge and unpleasant liquids.

Referring to FIGS. 16, the continuous wall 211, associated with the trash receptacle, is tapered or sloped in an inward direction from the open end 213 toward the closed end 212 so that the trash receptacles can be inserted into each other. This enables stacking a plurality of receptacles 210*a* for storage or shipping. When the trash receptacles 210*a* are stacked, the pouch assembly 214 supports the closed ends 241 of the stepped portions 240 of an inserted trash receptacle and provides a gap similar to FIGS. 5 and 6.

FIGS. 17 through 21 showing an alternate pouch assembly embodiment 314 that is not integral with the trash receptacle 310, but is adapted for use with the liner cartridge 20 of the present waste management system invention. The alternate pouch assembly 314 includes a U-shaped flange 344, a front panel 315, and a pair of side panels 316 that extend outward from a U-shaped flange 344 to the front panel 315. Front panel 315 extends between the side panels 316, and a sloped bottom panel 345, located between the side panels 316, extends from the U-shaped flange 344 to front panel 315 to provide a closed end 312 opposite open end 313. Front panel 315 includes an elongated notch 346 that extends from the open end 313 in a downward or longitudinal direction. Notch 346 provides access to the perforated notch 23 through which folded trash liners 22*a* are dispensed from cartridge 20, see FIGS. 3, 22, and 23.

As disclosed in the previous embodiments, each pair of sidewalls 316 is spaced apart at a distance that corresponds with the width of liner cartridge 20 so that each inward extending clasp 317 is positioned to correspond with and penetrate a perforated retainer slot 21 in the liner cartridge as illustrated in FIG. 28. The opposed clasps 317 releasably fix liner cartridge 20 between the spaced apart sidewalls 316. Alternatively, as shown in FIG. 29, the opposed clasps may comprise fasteners 349 that are inserted through apertures 350 provided in the sidewalls 316 to penetrate the retainer slots 21 and releasably fix the liner cartridge within pouch assembly 314.

Figure 21:
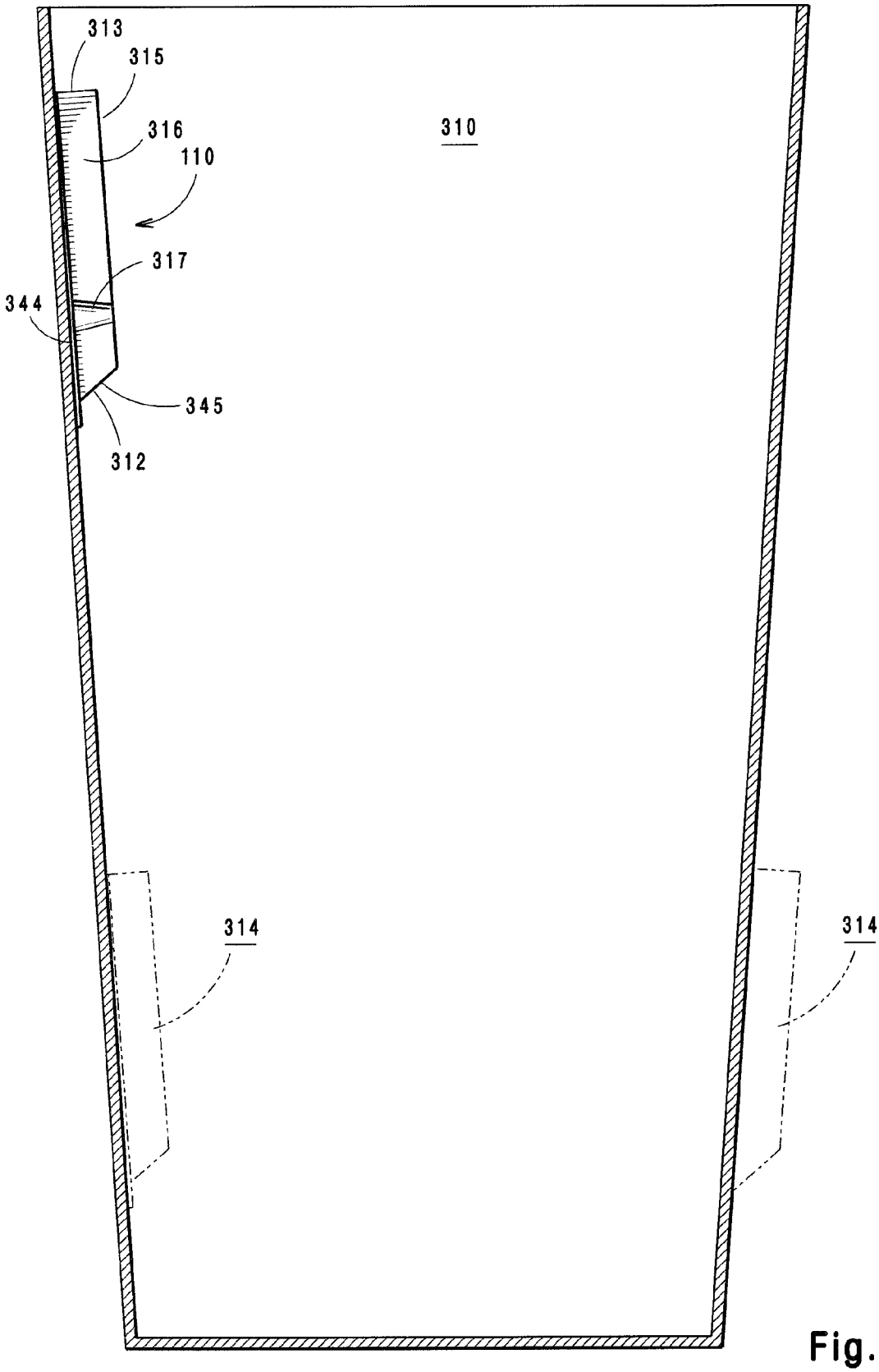
FIG. 21 is a cross-section view similar to FIG. 20 showing the alternate pouch fixed to an upper portion of the inside wall.

Referring in particular to FIG. 17, showing a back elevation of pouch assembly 314; the back surface of the U-shaped flange 344 includes an adhesive fastening means comprising a double sided adhesive strip 347 and a removable protective cover 348 that is removed to fix the pouch assembly 314 to a surface of a trash receptacle 310 used in the present waste management system. Preferably pouch assembly 314 is fixed to an inside surface of continuous wall 311 of the receptacle. However, as illustrated in FIG. 21, the pouch assembly may be fixed to any interior or exterior surface of trash receptacle 310 that is most convenient to an individual user without departing from the scope of the present invention. In addition, pouch assembly 314 could be fixed to a convenient surface adjacent the trash receptacle, for example the inside of a kitchen cabinet, without departing from the scope of the present invention. Referring again to FIG. 17 and to FIG. 19, the pouch assembly 314 may be fixed to a selected surface of the trash receptacle 310 with fasteners inserted through apertures 351 provided in the U-shaped flange 344.

Referring to the liner cartridge 20 used in combination with the trash receptacle and pouch assembly embodiments of the present waste management system invention is shown in the drawing FIGS. 25 through 29. The liner cartridge 20 comprises a closed container having a top and bottom panel 25 and 26 respectively, a front panel 27 and back panel 28 and side panels 29 and 30 respectively. The front and back panels 27 and 28 have a width that corresponds with the distance between the sidewalls of the various above disclosed pouch assembly embodiments so that liner cartridge 20 fits between the side walls as shown in for example, FIGS. 22, 23, and 28.

Referring to FIGS. 22 and 23, front panel 27 includes a longitudinal perforated notch 23 that extends along a length of panel 27 and intersects a transverse perforated slit 24 that extends along a portion of the front panel. When the perforations are broken, the opened notch 23*a* enables a user to grasp a replacement liner 22*a* and pull it from cartridge 20 while the opened perforated slit 24*a* provides an opening of sufficient width and tightness to slip the folded liner 22*a* from cartridge 20, and at the same time, prevent the next replacement liner from following the pulled replacement liner.

As shown in FIGS. 22, 27, 28, and 29, the side panels 29 and 30 include a perforated retainer slot 21 that is positioned along each side panel to correspond with the inward extending clasp arrangements 17, 117, 217, and 317 in the above pouch assembly embodiments when the liner cartridge is between the sidewalls of the respective pouch assembly embodiments. For example, referring in particular to FIG. 27, the retainer slot 21, provided in each side panel 29 and 30, is shown penetrated by one of the clasps 217 provided in the pairs of sidewalls 216 of the integral pouch assembly 214 of trash receptacle embodiment 210.

FIG. 28 shows a liner cartridge 20 with an opened perforated notch 23*a* and opened perforated slit 24*a* inserted between the sidewalls 316 of the non-integral pouch assembly 314. The opposed clasps 317 provided along sidewalls 316, penetrate the retainer slots 21 and removably fix the liner cartridge 20 within the pouch assembly 314 so that replacement liners 22*a* may be dispensed from the opened perforated notch 23*a* and opened perforated slit 24*a* without accidentally withdrawing cartridge 20 from the pouch assembly.

Referring again to FIG. 29, retainer slots 21 can be penetrated by the above mentioned removable fasteners 417 inserted through apertures 350 provided at an appropriate location along the side panels 29 and 30 in the pouch assembly.

Referring to FIGS. 24 and 25, the interior space 52 of the liner cartridge 20 houses a plurality of replacement liners 22*a* folded along both the length and width of the liner to fit the interior space 52 provided within the liner cartridge. The plurality of folded replacement liners 22*a* is hung from a support member 53. In FIGS. 24, 25, and 26, the support member is U-shaped comprising a first support leg 54 and a second support leg 55 extending from a base 56 to a location between the top panel 25 and the perforated transverse slit 24 of cartridge 20. Base 56 is positioned on, or attached to, the bottom panel 26, and the width of the support legs 54 and 55, extending in a direction between the side panels 29 and 30, proximate the width of the folded replacement liners 22*a*.

In FIG. 26A the support member comprises an alternate V-shaped embodiment comprising a first support leg 54*a* and a second support leg 55*a* supported on and extending upward from the bottom panel 26 of cartridge 20 to a location between the top panel and the perforated transverse slit as shown in FIG. 26.

The plurality of replacement liners 22*a* are draped, along their length, over the support legs 54 and 55 in a serpentine configuration so that the middle or central portion 57 of the liners 22*a* is suspended between support legs 54 and 55, the first end portion 58 of the liners 22*a* is suspended between the first support leg 54 and the front panel 27 of the cartridge 20, and the second end portion 59 opposite the first end portion, is suspended between the second support leg 55 and the back panel 28 of the cartridge 20. The support member 53 prevents the draped replacement liners from slumping or falling toward the bottom panel 26 of the liner cartridge, and maintains the supported replacement liners at a position adjacent the perforated notch 23 and perforated slit 24 for easy removal from the cartridge 20.

In addition, as shown in FIG. 26, support legs 54 and 55 may be biased toward the front and back panels 27 and 28 respectively, so that the next replacement liner is always positioned against, or in close proximity, of the perforated notch 23 and perforated slit 24 to facilitate easy removal of the next replacement liner. FIG. 26 shows that even when there is only one remaining replacement liner 22*a* the biased support legs maintain the single liner adjacent the notch and slit for easy removal.

It should be understood that, although the drawing figures show both a U-shaped support member and a V-shaped support member, any support member shape, for example a W-shaped support or a single leg support, etc, capable of maintaining a next replacement liner against or within close proximity of the perforated notch 23 and perforated slit 24, to facilitate easy removal thereof, may be used without departing from the scope of the present invention.

As such, an invention has been disclosed in terms of preferred embodiments and alternate embodiments thereof, which fulfills each one of the objects of the present invention as set forth above and provides a waste management system that includes a combination trash receptacle, pouch, and cartridge removably fixed within the pouch and containing a supply of replacement liners that are always supported at a position for easy access and removed from the cartridge. Of course, various changes, modifications, and alterations from the teachings of the present invention may be contemplated by those skilled in the art without departing from the intended spirit and scope thereof. It is intended that the present invention only be limited by the terms of the appended claims.

The invention claimed is:

1. A waste management system, comprising:

a) a trash receptacle having a continuous wall that extends between an open end and a closed end;

b) a pouch assembly integral with said trash receptacle comprising;

i) a panel that extends in an upward direction from said closed end, said panel positioned inboard from said trash receptacle continuous wall, ii) at least one pair of sidewalls extending between said panel and said trash receptacle continuous wall to provide at least one pouch, each sidewall including a sidewall clasp, and c) a cartridge inserted into each said at least one pouch, said cartridge including perforated retainer slots positioned along a surface of said cartridge to correspond with each said a sidewall clasp, each one of said perforated retainer slots penetrated through by a corresponding said a sidewall clasp to fix said cartridge within said pouch, said cartridge including a plurality of liners housed within the cartridge adjacent an access opening so that a single liner can be pulled from said plurality of liners through said access opening of the cartridge fixed within the pouch.

2. The waste management system recited in claim 1, whereby said panel extending in an upward direction from said trash receptacle closed end is positioned to support a closed end of an inserted trash receptacle to provide an arrangement of at least two stacked trash receptacles, said inserted trash receptacle supported at an elevated position that provides a gap between adjacent continuous walls of the at least two stacked trash receptacles.

3. Waste management apparatus, comprising:

a) a trash receptacle having a continuous wall that extends between an open end and a closed end;

b) a pouch assembly integral with said trash receptacle, comprising i) a continuous panel extending in an upward direction from said trash receptacle closed end and positioned inboard from said trash receptacle continuous wall; and ii) at least one pair of sidewalls extending between said continuous panel and said trash receptacle continuous wall to provide at least one pouch, each sidewall including a sidewall clasp; and c) a cartridge containing a plurality of liners, comprising:

i) a closed container defined by a front panel opposite a back panel, said front panel including a longitudinal notch that intersects a transverse slit to provide an access into said closed container through which a single liner pulled from said plurality of liners is dispensed, a pair of side panels extending between said front panel and said back panel, and a top panel opposite a bottom panel, the top and bottom panels extending between said front panel, said back panel, and said pair of side panels;

ii) perforated retainer slots positioned along said cartridge to correspond with each said sidewall clasp when said cartridge is inserted into each said at least one pouch, each one of said perforated retainer slots penetrated through by a corresponding said sidewall clasp to fix said cartridge within said at least one pouch.

4. The waste management apparatus recited in claim 3, comprising a reservoir defined by the bounds of said continuous panel extending in an upward direction from said trash receptacle closed end.

5. The waste management system recited in claim 3, whereby said continuous panel extending upward from said trash receptacle closed end is positioned to support a closed end of an inserted trash receptacle to provide an arrangement of at least two stacked said trash receptacles, said inserted trash receptacle supported at an elevated position that provides a gap between adjacent continuous walls of said at least two stacked trash receptacles.

* * * * *